United States Patent [19]

Miyakawa et al.

[11] 4,407,923

[45] Oct. 4, 1983

[54] ONE COMPONENT MAGNETIC DEVELOPER

[75] Inventors: Nobuhiro Miyakawa, Suita; Masanori Fujii, Sakai; Kouzi Maekawa, Kyoto; Haruo Koyama, Hirakata; Takashi Teshima, Amagasaki, all of Japan

[73] Assignee: Mita Industrial Co., Ltd., Osaka, Japan

[21] Appl. No.: 391,721

[22] Filed: Jun. 24, 1982

[30] Foreign Application Priority Data

Jun. 26, 1981 [JP] Japan ..... 56-98281

[51] Int. Cl.[3] ..... G03G 9/14; G03G 9/08

[52] U.S. Cl. ..... 430/106.6; 430/903

[58] Field of Search ..... 430/106.6, 107, 903

[56] References Cited

U.S. PATENT DOCUMENTS 3,520,811 7/1970 Swoboda ..... 430/106.6 X
3,627,682 12/1971 Hall et al. ..... 430/106.6
3,645,770 2/1972 Flint ..... 355/300
3,839,029 10/1974 Berg et al. ..... 430/106.6 X
4,220,698 9/1980 Brynko et al. ..... 430/106.6
4,272,600 6/1981 Sypula et al. ..... 430/106.6 X
4,311,779 1/1982 Miyakawa et al. ..... 430/903 X
4,315,064 2/1982 Miyakawa et al. ..... 430/903 X
4,362,803 12/1982 Miyakawa et al. ..... 430/106.6 X

*Primary Examiner*—Roland E. Martin, Jr.
*Attorney, Agent, or Firm*—Sherman & Shalloway

[57] ABSTRACT

Disclosed is a dry magnetic developer consisting essentially of a particulate shaped article of a composition comprising a binder resin medium and a powdery magnetic material dispersed in the binder resin medium, wherein said composition comprises as the powdery magnetic material a non-pulverizing agglomerate having a secondary particle size of 1 to 10 microns, which is formed by granulating and sintering fine cubic particles of magnetite or other ferrite having a primary particle size of 0.1 to 1 micron.

6 Claims, 1 Drawing Figure

X 5000

ONE COMPONENT MAGNETIC DEVELOPER

BACKGROUND OF THE INVENTION

1. Field of the Invention

The present invention relates to a magnetic developer. More particularly, the present invention relates to a magnetic developer which is prominently excellent in the property being electrically charged by mutual friction of developer particles and which can provide a clear and sharp image having a high density.

2. Description of the Prior Art

As the developer capable of developing an electrostatic latent image without using a particular carrier, there is known a so-called one-component type magnetic developer comprising a powder of a magnetic material contained in developer particles.

As one type of this one-component magnetic developer, there is known a so-called conductive magnetic developer in which a fine powder of a magnetic material is incorporated in developer particles to impart a property of being magnetically attracted and a conducting agent such as carbon black is distributed on the surfaces of the particles to impart them electrically conductive (see, for example, the specifications of U.S. Pat. No. 3,689,245 and U.S. Pat. No. 3,965,022). When this conductive magnetic developer is brought in the form of a so-called magnetic brush into contact with an electrostatic latent imagecarrying substrate to effect development of the latent image, there can be obtained an excellent visible image free of a so-called edge effect or fog. However, as is well known, when the developer image is transferred to an ordinary transfer sheet from the substrate, a serious problem arises. More specifically, as described in Japanese Patent Application Laid-Open Specification No. 117435/75, when the inherent electric resistance of a transfer sheet used is lower than $3\times10^{13}$ Ω-cm as in case of plain paper, broadening of contour or reduction of the transfer efficiency is caused by scattering of developer particles at the transfer step. This disadvantage is moderated to some extent by coating the toner-receiving surface of the transfer sheet with a resin, wax or oil having a high electric resistance. This improvement, however, is reduced under a high-humidity condition. Furthermore, the cost of the transfer sheet is increased by coating with a resin or the like and the feel of the transfer sheet is reduced.

As another type of the one-component magnetic developer, there is known a non-conductive magnetic developer comprising an intimate particulate mixture of a fine powder of a magnetic material and an electroscopic binder. For example, the specification of U.S. Pat. No. 3,645,770 discloses an electrostatic photographic reproduction process in which a magnetic brush (layer) of the above-mentioned non-conductive magnetic developer is charged with a polarity opposite to the polarity of the charge of an electrostatic latent image to be developed by means of corona discharge, the charged developer is brought into contact with a latent image-carrying substrate to develop the latent image and the developer image is transferred onto a transfer sheet. This electrostatic photographic reproduction process is advantageous in that a transfer image can be formed even on plain paper as the transfer sheet. However, this process is still disadvantageous in that it is difficult to uniformly charge the magnetic brush of the non-conductive magnetic developer even to the base portion thereof, it is generally difficult to form an image having a sufficient density and the apparatus become complicated because a corona discharge mechanism should be disposed in the developing zone.

Recently, there have been proposed a process in which an electrostatic latent image is developed by frictional charging of a non-conductive magnetic developer by frictional contact of the developer with the surface of a latent image-carrying substrate (see Japanese Patent Application Laid-Open Specification No. 62638/75) and a process in which development is effective by utilizing dielectric polarization of a non-conductive magnetic developer (see Japanese Patent Application Laid-Open Specification No. 133026/76). In the former process, however, if development conditions are not strictly controlled, fogging is readily caused (especially when the degree of the contact of the tip of the spike of magnetic toner particles with the surface of the photosensitive material is high) or fixing or blocking of the magnetic toner particles onto the developing sleeve is caused, and this undesirable phenomenon is especially conspicuous when the copying operation is conducted continuously. In the latter process, there does not arise the problem of fogging, but since a visible image is formed by developing a latent image by utilizing the dielectric polarizing effect induced in the magnetic toner, the low-potential area of the latent image is not effectively developed. Accordingly, in the resulting print, a low-density portion of an original is hardly reproduced and reproduction of a half tone is difficult. Moreover, prints obtained according to these two processes are poor in the image sharpness, and when a p-type photosensitive material such as selenium is used as the photosensitive plate and a positively charged image is developed, it is very difficult to obtain an image having a sufficient density according to any of the foregoing two processes.

Furthermore, the specification of U.S. Pat. No. 4,102,305 discloses a process in which a one-component type magnetic developer, the electric resistance of which changes depending on the intensity of the electric field, namely a one-component type magnetic developer which becomes substantially conductive in a high electric field but has a high electric resistance in a low electric field, is used, a high voltage is applied between a magnetic brush-forming sleeve and a photosensitive plate to effect development under such conditions that the developer particles become conductive and transfer of the developer particles to a transfer sheet is carried out in a low electric field or in an electric field-free state to obtain an excellent transferred image. This specification teaches that the above-mentioned developer having a high electric field dependency of the electric resistance is prepared by spray-granulating 50% by weight of stearate-coated magnetite and 50% by weight of a styrene/n-butyl methacrylate copolymer. This process is excellent in the above idea of obtaining a good transferred image, but this process is disadvantageous in that a peculiar high voltage apparatus is necessary for the development and though the formed image has a high density, the image sharpness is still insufficient.

Moreover, the specification of U.S. Pat. No. 4,121,931 discloses a process in which an electrically insulating one-component type magnetic developer is used, a magnetic brush-forming sleeve is used as an electrode and a voltage is applied between this electrode and a photosensitive plate to cause a turbulent agitation in the developer on the sleeve, whereby the developer particles are uniformly charged. This process, however, is disadvantageous in that a high voltage apparatus should be disposed in the developing zone and special means should be disposed to agitate the developer particles on the sleeve.

As will be apparent from the foregoing description, the conventional researches made on one-component type magnetic developers and developing processes using these developers are concentrated to the composition of the developer, the developer-preparing process and the process for charging developer particles, but properties of magnetite to be incorporated into the developer have hardly been studied.

Ordinarily, when a magnetic brush of a one-component type developer is brought into contact with the surface of an electrostatic latent image-carrying substrate, the individual developer particles receive an electrostatic attracting force (Coulomb force) acting between the developer particles and the electrostatic latent image and a magnetic attracting force acting between the developer particles and a magnetic brush-forming magnet. The developer particles on which the Coulomb force is larger are attracted to the electrostatic latent image, while the developer particles on which the magnetic attrating force is larger are attracted to the magnetic sleeve, with the result that development is effected according to the electrostatic latent image on the substrate. Therefore, it is required for the one-component type magnetic developer that a certain balance should be maintained between magnetic characteristics and charging characteristics at the development step. Accordingly, it will readily be understood that the characteristics of the magnetic material powder used for the one-component type magnetic developer have important influences on the characteristics of an image which will be formed.

SUMMARY OF THE INVENTION

We found that if a non-pulverizing agglomerate formed by sintering fine cubic particles of magnetite or ferrite formed by granulation is used as the particulate magnetic material to be incorporated into dry magnetic developer particles, the sharpness and density of a formed image can prominently be improved over the sharpness and density of an image obtained by using the conventional magnetic material.

More specifically, in accordance with the present invention, there is provided a dry magnetic developer consisting essentially of a particulate shaped article of a composition comprising a binder resin medium and a powdery magnetic material dispersed in the binder resin medium, wherein said composition comprises as the powdery magnetic material a non-pulverizing agglomerate having a secondary particle size of 1 to 10 microns, which is formed by granulating and sintering fine cubic particles of magnetite or other ferrite having a primary particle size of 0.1 to 1 micron.

BRIEF DESCRIPTION OF THE DRAWINGS

The FIGURE is an electron microscope photograph of magnetite consisting of a non-pulverizing agglomerate of cubic particles, which is used in the present invention.

DETAILED DESCRIPTION OF THE PREFERRED EMBODIMENTS

Figure 1:
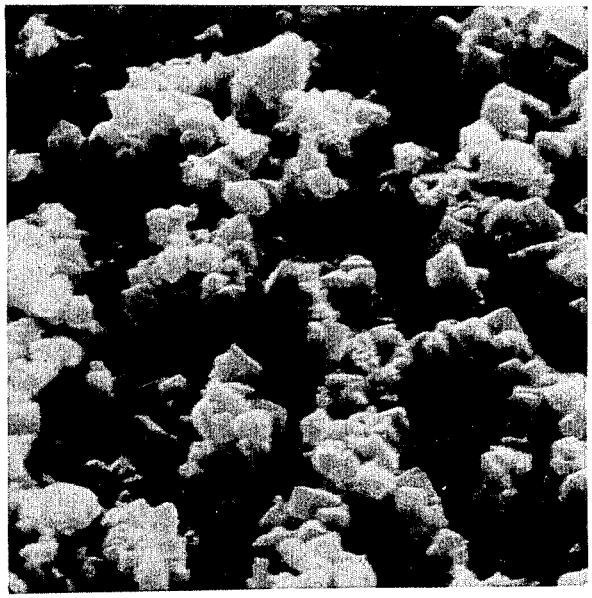

The powdery magnetic material that is used in the present invention is characterized in that the powdery magnetic material consists of a non-pulverizing agglomerate having a secondary particle size of 1 to 10 microns, which is formed by granulating and sintering fine cubic particles of magnetite or ferrite having a primary particle size 0.1 to 1 micron.

FIG. 1 is an electron microscope photograph of a non-pulverizing agglomerate of magnetite that is preferably used in the present invention.

By the term "non-pulverizing agglomerate" used in the instant specification and appended claims is meant an agglomerate of fine particles which are densely aggregated with one another as shown in FIG. 1 and in which the particle size distribution is not substantially changed even by an ordinary pulverizing treatment, for example, 5 hours' ball-milling treatment.

This non-pulverizing agglomerate has a number average particle size of 1 to 10 microns, especially 2 to 7 microns, as measured by an electron microscope. Namely, it has a particle size larger than the particle size of ordinary magnetite particles.

Since the particulate magnetic material used in the present invention has the above-mentioned dense aggregate structure and a relatively coarse particle size, the volume per unit weight, namely the bulk, is smaller than that of particles of magnetite of the cubic or needle crystal form or amorphous magnetite heretofore used for one-component magnetic developers. Accordingly, in the one-component type magnetic developer of the present invention, the resin/magnetite volume ratio can be made much higher than that in the conventional one-component type magnetic developers when the comparison is made based on the same weight ratio of magnetite. Accordingly, as will readily be understood, in the one-component type magnetic developer of the present invention, much higher inherent charging characteristics can be given to the resin.

As pointed out hereinbefore, the powdery magnetic material used in the present invention has a smaller bulk, that is, a larger apparent density, than ordinary magnetite. More specifically, the powdery magnetic material has an apparent density of 0.4 to 1.5 m/ml, especially 0.45 to 1.3 g/ml, as determined according to the method of JIS K-5101.

Since the powdery magnetic material that is used in the present invention consists of a non-pulverizing agglomerate of fine cubic particles, this powdery magnetic material is characterized in that the magnetic material is easily exposed to the surfaces of the developer particles. More specifically, when this non-pulverizing agglomerate is kneaded in a binder medium and the kneaded composition is cooled and pulverized, since the non-pulverizing agglomerate has a relatively large particle size and the particles have a rough rugged surface, the non-pulverizing agglomerate is exposed to fracture faces of the kneaded composition. Accordingly, in the magnetic developer of the present invention, the faces of the electroscopic binder resin medium and the faces of the magnetic material are co-present on the surfaces of the developer particles, and when the developer particles are brought into contact with one another, frictional charging of the magnetic developer particles can be accomplished very effectively as in the case of a two-component type developer where toner particles are conveniently charged by frictional contact between magnetic carrier particles and electroscopic toner particles.

As pointed out hereinbefore, in the present invention, the resin/magnetic material volume ratio is much higher than in the conventional developers and the inherent charging characteristics of the resin are highly improved. Moreover, the surfaces of the developer particles have a structure in which frictional self-charging is readily caused. For these reasons, the magnetic developer of the present invention can be charged very effectively and advantageously.

The non-pulverizing agglomerate of cubic particles used in the present invention is prepared according to the following method, though an applicable method is not limited to this method.

A weakly alkaline aqueous solution, for example, aqueous ammonia, is added to an aqueous solution of iron (II) sulfate to form precipitates of iron (III) hydroxide. The precipitates are subjected to a hydrothermal treatment under pressure while maintaining the pH value of the mother liquor at 3 to 9, whereby gel-like precipitates of iron hydroxide are changed to cubic particles of alpha-$Fe_2O_3$ (Hematite). If the weakly alkaline aqueous solution is used to maintain the pH value of the mother liquor to a level close to the acidic side, fine cubic particles which tend to aggregate are formed, and the so-obtained particles are aged by carrying out the hydrothermal treatment at 150° to 230° C. for a long time, for example, more than 50 hours, whereby alpha-diiron trioxide having the configuration specified in the present invention can be obtained. If this alpha-diiron trioxide is reduced under known conditions, for example, by heating it at 400° C. with hydrogen in a reducing furnace, triiron tetroxide ($Fe_3O_4$) having the configuration specified in the present invention can be obtained. The reducing treatment is ordinarly carried out so that the $Fe^{2+}/Fe^{3+}$ atomic ratio is in the range of from 0.9/1.0 to 1.1/1.0.

The so-obtained fine cubic particles of magnetite are dispersed together with a binder into a water to form a slurry, and the slurry is spray-granulated to obtain a granulation product having the above-mentioned size. If necessary, the granulation product is subjected to a sieving treatment. Then, the granulation product is sintered in vacuum or in an inert atmosphere at a temperature higher than 600° C., and if necessary, rough pulverization and classification are carried out. Thus, a non-pulverizing agglomerate of magnetite is prepared.

As the binder, there are preferably used water-soluble binders such as polyvinyl alcohol, carboxymethyl cellulose, carboxymethyl starch, sodium alginate and gum arabic.

It is especially preferred that the non-pulverizing agglomerate that is used in the present invention should consist of magnetite ($Fe_3O_4$). However, the non-pulverizing agglomerate may be composed of ferrite other than magnetite, and ferrite may be used singly or in combination with magnetite in the present invention. Ferrite having a composition represented by the following general formula:

$$MO.Fe_2O_3$$

wherein M stands for a divalent metal such as $Mn^{2+}$, $Co^{2+}$, $Cu^{2+}$, $Ni^{2+}$, $Zn^{2+}$ or a mixture thereof.

is used in the present invention.

A non-pulverizing agglomerate of ferrite may also be prepared by dispersing fine cubic particles of ferrite together with a binder into water to form a slurry, spray-granulating the slurry, sieving the granulation product if necessary, sintering the granulation product at a temperature higher than 1100° C., cooling the sintered product and, if necessary, roughly pulverizing and classifying the sintered product.

As the binder medium for dispersing this non-pulverizing agglomerate of cubic particles, there can be used resins, waxy materials or rubbers which show a fixing property under application of heat or pressure. These binder medium may be used singly or in the form of a mixture of two or more of them. It is preferred that the volume resistivity of the binder medium be at least $1\times10^{15}$ Ω-cm as measured in the state where magnetite is not incorporated.

As the binder medium, there are used homopolymers and copolymers of mono- and di-ethylenically unsaturated monomers, especially (a) vinyl aromatic monomers and (b) acrylic monomers.

As the vinyl aromatic monomer, there can be mentioned monomers represented by the following formula:

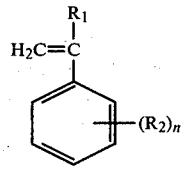

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of up to 2 inclusive of zero, such as styrene, vinyl toluene, alpha-methylstyrene, alpha-chlorostyrene, vinyl xylene and vinyl naphthalene. Among these vinyl aromatic monomers, styrene and vinyl toluene are especially preferred.

As the acrylic monomer, there can be mentioned monomers represented by the following formula:

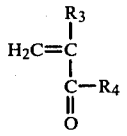

wherein $R_3$ stands for a hydrogen atom or a lower alkyl group, and $R_4$ stands for a hydroxyl group, an alkoxy group, a hydroxyalkoxy group, an amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As another monomer to be used singly or in combination with the above-mentioned monomer (a) or (b), there can be mentioned, for example, conjugate diolefin monomers represented by the following formula:

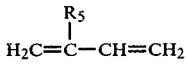

wherein $R_5$ stands for a hydrogen atom, a lower alkyl group or a chlorine atom, such as butadiene, isoprene and chloroprene.

As still another monomer, there can be mentioned ethylenically unsaturated carboxylic acids and esters thereof such as maleic anhydride, fumaric acid, crotonic acid and itaconic acid, vinyl esters such as vinyl acetate, and vinyl pyridine, vinyl pyrrolidone, vinyl ethers, acrylonitrile, vinyl chloride and vinylidene chloride.

It is preferred that the molecular weight of such vinyl type polymer be 3,000 to 300,000, especially 5,000 to 200,000.

In the present invention, it is preferred that the above-mentioned agglomerate be used in an amount of 40 to 70% by weight, especially 45 to 65% by weight, based on the sum of the amounts of the binder medium and the magnetic material. The agglomerate is uniformly and homogeneously kneaded with the binder medium and the kneaded composition is granulated, whereby the intended one-component type dry magnetic developer is obtained.

Known auxiliary components for developers may be added according to known recipes prior to the above-mentioned kneading and granulating steps. For example, pigments such as carbon black and dyes such as Acid Violet may be added singly or in combination in amounts of 0.5 to 5% by weight based on the total composition so as to improve the hue of the developer. Furthermore, a filler such as calcium carbonate or powdery silica may be added in an amount of up to 20% by weight based on the total composition to obtain a bulking effect. In the base where fixing is effected by a heat roll, an offset-preventing agent such as a silicone oil, a low-molecular-weight olefin resin or a wax may be used in an amount of 2 to 15% by weight based on the total composition. In the case where fixing is effected by means of a pressure roll, a pressure fixability-improving agent such as paraffin wax, an animal or vegetable wax or a fatty acid amide may be used in an amount of 5 to 30% by weight based on the total composition. Furthermore, in order to prevent cohesion or agglomeration of developer particles and improve the flowability thereof, a flowability-improving agent such as a fine powder of polytetrafluoroethylene or finely divided silica may be added in an amount of 0.1 to 1.5% by weight based on the total composition.

Shaping of the developer can be accomplished by cooling the above-mentioned kneaded composition, pulverizing the composition and, if necessary, classifying the pulverization product. Mechanical high-speed stirring may be conducted so as to remove corners of indeterminate-shape particles.

It is ordinarily preferred that the number average particle size of the developer particles be in the range of 5 to 35 microns and be at least 2 times the number average particle size of the agglomerate particles, through the particle size of the developer particles is changed to some extent according to the intended resolving power. The developer of the present invention comprising indeterminate-shape particles formed by kneading and pulverization according exerts enhanced effectsof increasing the transfer efficiency and elevating the image sharpness.

In the electrostatic photographic reproduction process using the developer according to the present invention, formation of an electrostatic latent image can be performed according to any of the known methods. For example, an electrostatic latent image can be formed by uniformly charging a photoconductive layer formed on a conductive substrate and subjecting the photoconductive layer to imagewise exposure.

A visible image of the developer is formed by bringing a magnetic brush of the above-mentioned one-component type magnetic developer into contact with the electrostatic latent image-carrying surface of the substrate.

Development of the electrostatic latent image with the developer of the present invention can be accomplished, for example, according to the following procedures. The abovementioned one-component type magnetic developer is charged in a developer hopper. A non-magnetic sleeve is rotatably mounted on a lower end opening of the hopper, and a magnet is disposed in the interior of the sleeve so that the magnet turns in a direction opposite to the rotation direction of the sleeve. When the sleeve and magnet are rotated, a brush layer of the magnetic developer is formed on the sleeve, and this brush layer is cut into an appropriate length by a spike-cutting plate. Then, the brush layer of the developer is lightly contacted with a selenium drum which is rotated in the same direction as the rotation direction of the sleeve to develop an electrostatic latent image on the selenium drum with the magnetic developer.

Then, the developer image on the substrate is brought into contact with a transfer sheet, and corona charging is effected from the back surface of the transfer sheet with the same polarity as that of the electrostatic latent image, whereby the developer image is transferred onto the transfer sheet.

The present invention will now be described in detail with reference to the following Examples that by no means limit the scope of the invention. All of "parts" and "%" are by weight unless otherwise indicated.

EXAMPLE 1

A composition comprising 55 parts of agglomerated magnetite ($Fe_3O_4$) shown in Table 1, which was prepared according to the method described hereinbefore, 37 parts of a vinyl toluene/2-ethylhexyl acrylate copolymer (weight average molecular weight=83,000), 8 parts of low-molecular-weight polypropylene (average molecular weight=4,000) and 0.5 part of zinc stearate was kneaded and molten at 150° C. for 25 minutes by a two-roll kneading device. The kneaded composition was naturally cooled and roughly pulverized to a size of 0.5 to 2 mm by a cutting mill. Then, the roughly pulverized composition was finely pulverized by a jet mill and classified by a zigzag classifying machine to obtain a magnetic toner having a particle size within the range of from 5 to 35 microns. The classification was carried out so that the lower limit of the particle size range was at least 2 times the particle size of magnetite. Then, hydrophobic silica (R-972 supplied by Nippon Aerosil) was incorporated in an amount of 0.2% based on the total toner.

TABLE 1

| Agglomerated Magnetite | Apparent Density (g/ml) | Number Average Particle Size (μ) | Coercive Force (Oe) | Saturation Magnetization (emu/g) | Residual Magnetization (emu/g) |
|---|---|---|---|---|---|
| A | 0.469 | 1 | 144 | 88 | 13 |
| B | 0.567 | 3.5 | 167 | 87 | 14 |
| C | 0.587 | 5 | 171 | 87 | 15 |
| D | 0.591 | 7 | 181 | 86 | 16 |

The following copying test was carried out by using the so-prepared magnetic toners.

In a copying machine comprising a selenium drum (outer diameter=150 mm) as a photosensitive material, the intensity of a magnetic field on a developing sleeve (outer diameter=33 mm) having a magnet disposed therein through a non-magnetic member was adjusted to about 900 gauss, and the magnetic toner was applied to a developing roller of the so-called two-rotation system capable of rotating the magnet and the sleeve independently, while adjusting the distance between a spike-cutting plate and the sleeve to 0.3 mm. An arrangement was made so that the magnetic toner was supplied to the developing roller zone from a hopper. The distance between the surface of the photosensitive material and the developing roller was adjusted to 0.5 mm. The developing sleeve and photosensitive material were rotated in the same direction, and the magnet was rotated in the opposite direction. Under the foregoing conditions, charging (+6.7 KV), exposure, development, transfer (+6.3 KV), heater roller fixation and fur brush cleaning were performed. Slick paper having a thickness of 80 μm was used as a transfer sheet. The results of the copying test are shown in Table 2. The image density was measured on a solid black portion by using a commercially available reflective densitometer (supplied by Konishiroku Shashin Kogyo). A Copia test pattern supplied by Data Quest Co. was used as a copying test chart, and the gradient characteristic and resolving power were determined from a copy thereof.

TABLE 2

| Magnetic Toner | Image Density | Background Density | Sharpness | Resolving Power (lines/mm) | Gradient Characteristic (steps) |
|---|---|---|---|---|---|
| A | 1.52 | 0.09 | good | 8.0 | 11 |
| B | 1.53 | 0.09 | good to excellent | 8.0 | 12 |
| C | 1.53 | 0.09 | good to excellent | 8.0 | 11 |
| D | 1.38 | 0.09 | good to excellent | 7.1 | 11 |

It was found that the magnetic toner of the present invention could directly be applied to a conventional development apparatus using a conventional conductive magnetic toner and plain paper could be used as the transfer sheet, and that the obtained copy had a clear image without broadening of the image or scattering of the toner, which is often observed at the transfer of an image of the conductive magnetic toner. Furthermore, an image having a high density could be obtained and the reproduction of a half tone was excellent.

These magnetic toners had a volume resistivity of $1.2\times10^{14}$ to $4.6\times10^{14}$ Ω-cm and a dielectric constant of 3.59 to 3.90 as determined under conditions of an electrode spacing of 0.65 mm, an electrode cross-sectional area of 1.43 $cm^2$ and an electrode load of 105 $g/cm^2$. The electron microscope photograph of the agglomerate magnetite B is shown in FIG. 1. When the surface conditions of the foregoing toners were examined, it was found that in each toner, the agglomerate magnetite faces were exposed to parts of surfaces of the toner particles.

EXAMPLE 2

A composition comprising agglomerated magnetite (apparent density=0.531 g/ml, number average particle size=2.5 μm, coercive force=159 Oe, saturation magnetization=87 emu/g, residual magnetization=13 emu/g), a thermoplastic resin (styrene/butyl methacrylate copolymer, weight average molecular weight=27,000) and high density polyethylene (average molecular weight=4,000) at a mixing ratio shown in Table 3 was treated in the same manner as described in Example 1 to form a magnetic toner having a particle size within a range of from 6 to 20 μm.

TABLE 3

| Magnetic Toner | Mixing Ratio (parts) Agglomerated Magnetite | Thermoplastic Resin | High density Polyethylene |
|---|---|---|---|
| E | 75 | 20 | 5 |
| F | 65 | 28 | 7 |
| G | 55 | 36 | 9 |
| H | 45 | 44 | 11 |
| I | 35 | 52 | 13 |

The following copying test was carried out by using the so-obtained magnetic toners.

In a copying machine comprising a selenium drum as a photosensitive material, the magnetic toner was applied to a developing roller having a magnet disposed therein through a non-magnetic member while adjusting the distance between a spike-cutting plate and the developing roller to 0.3 mm. The distance between the surface of the photosensitive material and the developing roller was adjusted to 0.5 mm. The developing roller and photosensitive material were rotated in the same direction, but the moving speed of the developing roller was 2 times as high as the moving speed of the photosensitive material. Under the foregoing conditions, charging, exposure, development and heat fixation were performed. Slick paper having a thickness of 80 μm was used as a transfer sheet. The results of the copying test and the properties of the magnetic toners are shown in Table 4. The image density was measured on a solid black portion.

TABLE 4

| Magnetic Toner | Volume Resistivity (Ω-cm) | Electrostatic Capacitance (pF) | Dielectric Constant | Image Density | Sharpness (Image Quality) | Background Density |
|---|---|---|---|---|---|---|
| E | $9.5 \times 10^{13}$ | 9.1 | 4.67 | 0.68 | fair | 0.09 |
| F | $2.2 \times 10^{14}$ | 8.1 | 4.15 | 1.30 | good | 0.09 |
| G | $3.2 \times 10^{14}$ | 7.2 | 3.69 | 1.48 | excellent | 0.09 |
| H | $8.6 \times 10^{14}$ | 6.9 | 3.54 | 1.51 | excellent | 0.10 |
| I | $2.1 \times 10^{15}$ | 6.7 | 3.44 | 1.58 | good | 0.11 |

From the results shown in Table 4, it will readily be understood that when the agglomerate magnetite of the present invention is used in an amount of 40 to 70% by weight based on the total amount of the magnetite and binder resin medium, a developer having excellent properties can be obtained.

What is claimed is:

1. A dry magnetic developer consisting essentially of a particulate shaped article of a composition comprising a binder resin medium and a powdery magnetic material dispersed in the binder resin medium, wherein said composition comprises as the powdery magnetic material a non-pulverizing agglomerate having a secondary particle size of 1 to 10 microns, which is formed by granulating and sintering fine cubic particles of magnetite or other ferrite having a primary particle size of 0.1 to 1 micron.

2. A magnetic developer as set forth in claim 1, wherein the agglomerate has an apparent density of 0.4 to 1.5 g/ml as measured according to the method of JIS K-5101.

3. A magnetic developer as set forth in claim 1, wherein the developer particles have surfaces comprising faces of the exposed non-agglomerate and faces of the binder resin medium.

4. A magnetic developer as set forth in claim 1, wherein the binder resin medium has a volume resistivity of at least $1 \times 10^{15}$ Ω-cm as measured in the state where the non-pulverizing agglomerate is not incorporated.

5. A magnetic developer as set forth in claim 1, wherein the non-pulverizing agglomerate is present in an amount of 40 to 70% by weight based on the total amount of the binder resin medium and the powdery magnetic material.

6. A magnetic developer as set forth in claim 1, wherein the magnetic developer has a number average particle size of 5 to 35 μm, which is at least two times the number average particle size of the agglomerate.

* * * * *